United States Patent [19]

Cook

[11] 4,179,831

[45] Dec. 25, 1979

[54] DISPLAY SET-UP PATTERN

[75] Inventor: Trix C. Cook, Hartsdale, N.Y.

[73] Assignee: Textron Inc., Providence, R.I.

[21] Appl. No.: 818,269

[22] Filed: Jul. 22, 1977

[51] Int. Cl.[2] ..... G09F 3/18

[52] U.S. Cl. ..... 40/19.5; 35/7 R

[58] Field of Search ..... 35/7; 40/19.5, 124

[56] References Cited

U.S. PATENT DOCUMENTS

| | | | |
|---|---|---|---|
| 2,610,413 | 9/1952 | Dasey | 35/7 X |
| 3,460,281 | 8/1969 | Levy | 35/7 X |
| 3,799,357 | 3/1974 | Govang | 35/7 X |

*Primary Examiner*—Louis G. Mancene
*Assistant Examiner*—Wenceslao J. Contreras
*Attorney, Agent, or Firm*—O'Brien and Marks

[57] ABSTRACT

A display set-up pattern is disclosed for use in the setting up of retail pegboard displays. The pattern is mounted on the perforated board and hooks and packages are placed on the perforated board in locations indicated by information printed on the pattern. The pattern is formed of tearable material so that it may be torn from the completed display.

3 Claims, 5 Drawing Figures

DISPLAY SET-UP PATTERN

BACKGROUND OF THE INVENTION

1. Field of the Invention

The present invention relates to the setting up of displays in general and in particular to the setting up of perforated board displays of packaged items at retail locations.

2. Description of the Prior Art

It has been the prior practice in the art to paint, print or otherwise affix the pattern for the pegboard display directly on the perforated board itself. It is a disadvantage of this prior art practice that the pattern thus formed is unalterable thereby not allowing for changes in display arrangements to allow for changed market conditions or new products. It is another disadvantage of these prior art patterns that the unsightly display is exposed when the packages on any one hook are all purchased. The present invention is intended to overcome these disadvantages.

SUMMARY OF THE INVENTION

The present invention is summarized in that a display set-up pattern for use in arranging a retail perforated board display includes a single large sheet of tearable material, a plurality of package outlines printed on the sheet to indicate the locations of packages in the completed display, indicia means associated with each package outline to identify the type of package associated with each package outline, and hook guide means formed on the sheet and associated with each package outline to indicate the proper location for insertion of a perforated board hook to support each package.

It is an object of the present invention to provide a display set-up pattern so that retail perforated board displays may be quickly, easily and uniformly set up.

It is another object of the present invention to provide such a pattern that is economical and disposable so that the pattern may be regularly altered to accommodate marketing trends or new products.

It is another object of the present invention to provide a method of using such a display set-up pattern to quickly and efficiently arrange such a retail perforated board display.

Other objects, advantages and features of the present invention will become apparent from the following specification when taken in conjunction with the accompanying drawings.

DESCRIPTION OF THE PREFERRED EMBODIMENT

Figure 1:
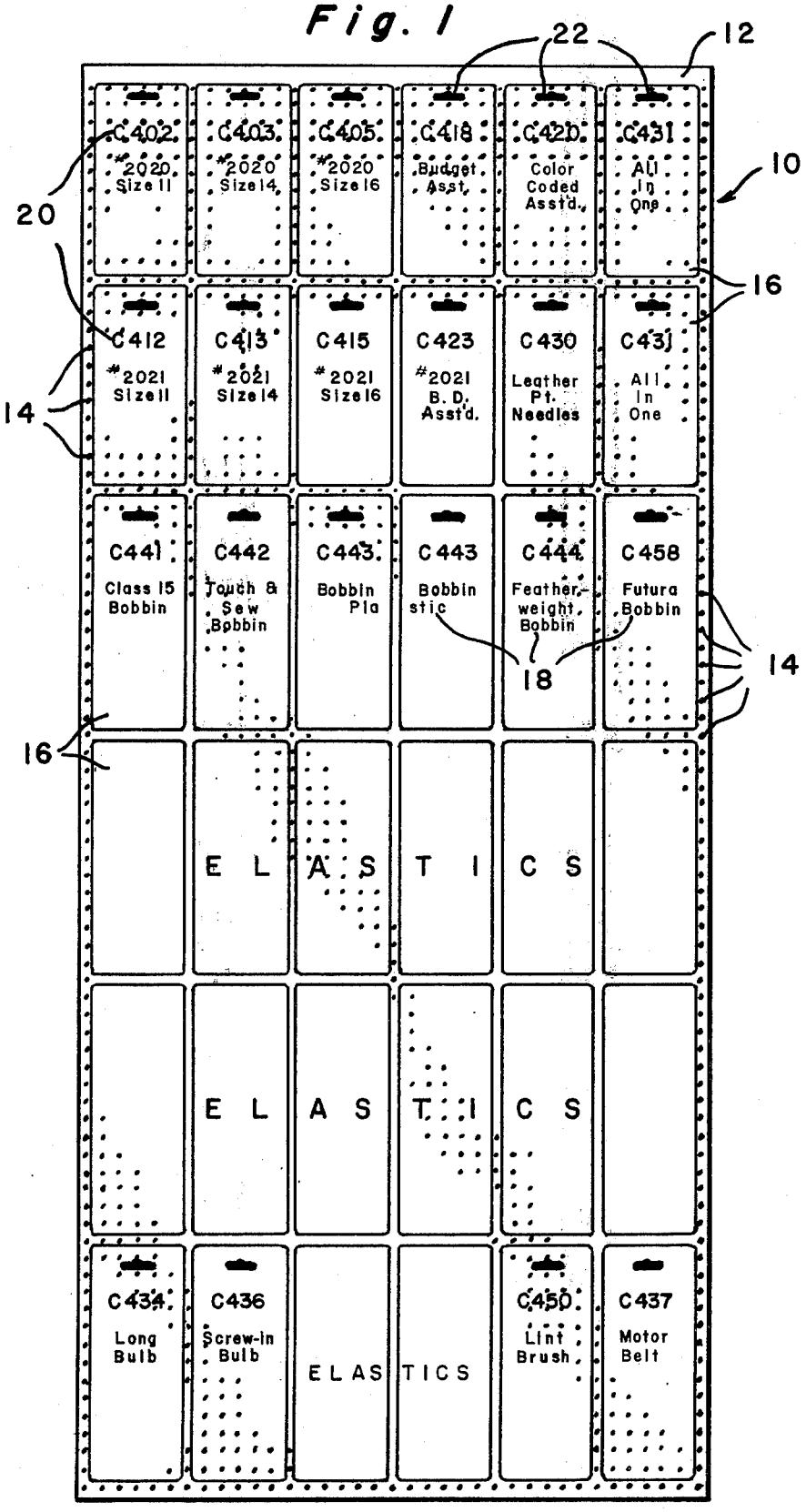
FIG. 1 is a front plan view of a display set-up pattern constructed according to the present invention.

Shown in FIG. 1 is a display set-up pattern, indicated generally at 10, constructed in accordance with the present invention. The set-up pattern 10 is formed as a single large sheet 12 of tissue paper or other easily tearable material, with a full scale size pattern of the display to be set up printed on its surface. Included in the printing on the set-up pattern 10 is a grid of black dots 14. The black dots 14 are sized to be approximately the same size as the holes in a conventional perforated board and one spaced on the grid on regular centers to correspond to the spacing of the holes on a perforated board. Also printed on the front surface of the sheet 12 are a series of package outlines 16 representing the outlines of the blister-type packages to be displayed in the completed perforated board retail display. The package outlines 16 would, of course, vary in size and shape depending on the particular packages to be displayed at any location. Associated with each of the package outlines 16 is a printed title 18, each title 18 either referring to one particular package outline 16 or referring to several in a series of similar package outlines 16. Also associated with at least some of the package outlines 16 and titles 18 are a series of code numbers 20, each different title 18 optionally having a corresponding code number 20. The code number 20 would correspond to either the manufacturer's or distributor's part or catalog number for the particular retail package, and the code numbers 20 may be used as a replacement for, or merely as a supplement to, the titles 18. Also printed within each of the package outlines 16 is a respective hook guide 22. Each of the hook guides 22 is positioned within its respective package outline 16 in such a way as to correspond to the position of the hole through the package through which the perforated board hook is ultimately to extend. The hook guides 22 may be positioned directly below or may extend over the appropriate one of the black dots 14 which corresponds to the hole in the perforated board through which the hook is to be inserted.

Figure 2:
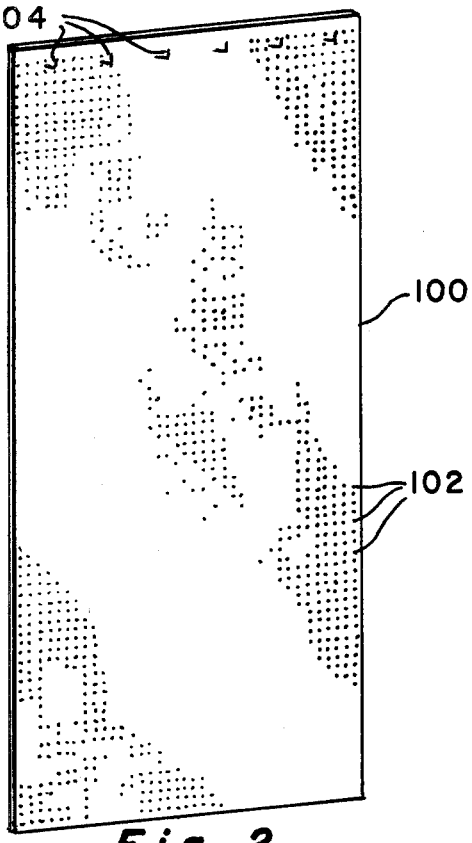
FIG. 2 shows a first step in the setting up of a retail perforated board display using the display set-up pattern of FIG. 1.

Shown in FIGS. 2 through 5 is a representation of the method of setting up a retail perforated board display using the display set-up pattern 10 of FIG. 1. FIG. 2 shows a conventional perforated board 100 formed of hardboard, metal or other rigid material and positioned in a vertical or near vertical orientation. A regularly spaced grid of identically sized holes 102 is formed in the perforated board 100, this grid of holes 102 being, of course, the model for the grid of black dots 14 on the display set-up pattern 10.

The first step in the setting-up of the retail display on the perforated board 100 is to provide a top row of perforated board hooks 104 along the one of the top rows of holes 102 in the perforated board 100. The top row of hooks 104 may be inserted in regular intervals on a predetermined row of holes 102, as determined by instructions accompanying the display set-up pattern 10, or may be a row of hooks permanently fixed to the perforated board 100 and forming a part of every display mounted thereon.

Figure 3:
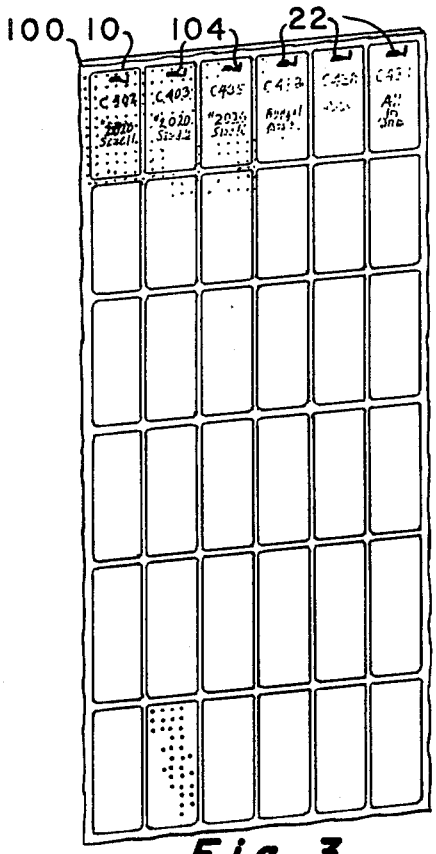
FIG. 3 shows a subsequent step in the setting up of a retail perforated board display using the display set-up pattern of FIG. 1.

As shown in FIG. 3, the next step in the setting up of the retail display is to insert the display set-up pattern 10 over the top row of the hooks 104. This is done by forcing the pattern 10 over the hooks 104 so that each of the hooks 104 penetrates through a respective one of the hook guides 22 in the top row of the package outlines 16 in the pattern 10. The pattern 10 should now lie flat against the perforated board 100, as shown in FIG. 3, and may be secured in position, if necessary, by strips of tape applied to its side or bottom.

Figure 4:
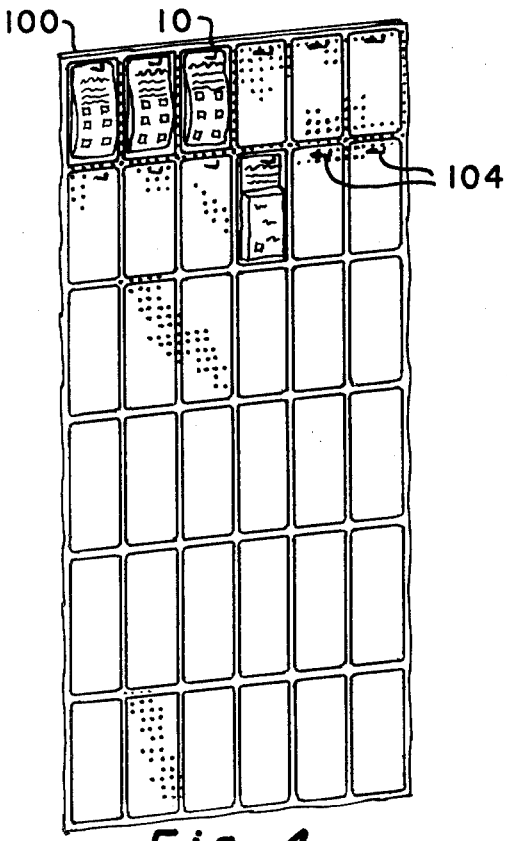
FIG. 4 shows yet another subsequent step in the arranging of a retail perforated board display using the display set-up pattern of FIG. 1.

Following the mounting of the pattern 10, the remaining hooks 104 can then be inserted into the appropriate holes 102 in the perforated board 100 by inserting the hooks 104 through the hook guides 22 in the pattern 10. As the hooks 104 are inserted the packages to be displayed may be hung on the hooks on the display with the particular packages being matched to the proper location by use of either the titles 18 or the code numbers 20. A partially filled display is shown in FIG. 4.

Figure 5:
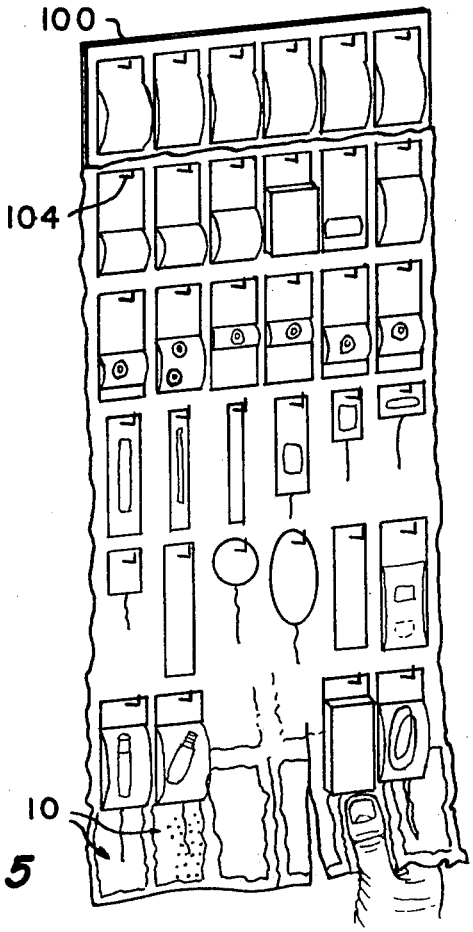
FIG. 5 shows a final step in the setting up of a retail perforated board display using the display set-up pattern of FIG. 1.

Once all the hooks 104 have been inserted and all the packages have been placed on the hooks, the display set-up pattern 10 may be removed, as shown in FIG. 5. The pattern 10 is removed by simply grabbing the pattern by its lower edge or by one side and tearing it out from under the packages on the perforated board 100. All the packages and the hooks 104 are left intact and in place and the desired completed retail display is then formed on the perforated board 100.

In this way a perforated board mounted retail display can be set up with a minimum of time and effort. This is an important advantage in that it saves time for the sales clerk and/or salesman who must stock the display. It is of particular advantage to distributors who must stock displays in retailer's stores since it minimizes the time spent by the route man at each of the many retail locations he must service. Furthermore the display set-up pattern 10 offers many advantages over the use of a pattern printed directly on the perforated board 100. Since the display set-up pattern 10 is obviously disposable and is relatively easy to manufacture, it can be changed at regular intervals, either simply to rearrange the display to attract consumers' interests or to provide space for new items. Also since all the displays set up through the use of the pattern 10 would be regularly re-stocked, any changes in the display would be uniform, changing the distributor's display uniformly at each of the retail locations at which there is a display. Also since the display set-up pattern 10 is very economical and easy to manufacture, there is little or no increase in cost.

Inasmuch as the present invention is subject to many modifications, variations and changes in detail, it is intended that the subject matter in the aforegoing specification or in the accompanying drawings be interpreted as illustrative and not in a limiting sense.

What is claimed is:

1. A display set-up pattern for use in arranging a retail perforated board display comprising a single large sheet of material, a plurality of package outlines printed on the sheet to indicate the locations of packages in the completed display, indicia means associated with each package outline to identify the type of package associated with each package outline, hook guide means formed on the sheet and associated with each package outline to indicate the proper location for insertion of a perforated board hook to support each package, and a grid of black dots printed on the sheet and sized and spaced so as to align with the holes in the perforated board.

2. A display set-up pattern as claimed in claim 1 wherein the indicia means includes the title of the item in the package to be mounted over each package outline.

3. A display set-up pattern as claimed in claim 1 wherein the indicia means includes a code number corresponding to a predetermined code number on each of the packages.

* * * * *